US008604892B2

(12) United States Patent
Ikuma

(10) Patent No.: US 8,604,892 B2
(45) Date of Patent: Dec. 10, 2013

(54) HIGH FREQUENCY ATTENUATOR AND HIGH FREQUENCY DEVICE USING THE SAME

(75) Inventor: Yoshiyuki Ikuma, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 282 days.

(21) Appl. No.: 12/869,191

(22) Filed: Aug. 26, 2010

(65) Prior Publication Data

US 2011/0115583 A1 May 19, 2011

(30) Foreign Application Priority Data

Nov. 16, 2009 (JP) ..... 2009-260934

(51) Int. Cl.
*H01P 1/22* (2006.01)

(52) U.S. Cl.
USPC ..... 333/81 A

(58) Field of Classification Search
USPC ..... 333/81 R, 81 A, 22 R
See application file for complete search history.

(56) References Cited

U.S. PATENT DOCUMENTS 4,456,894 A * 6/1984 Lapart ..... 333/22 R

FOREIGN PATENT DOCUMENTS

| | | |
|---|---|---|
| JP | 2000-183609 | 6/2000 |
| JP | 2000-261209 | 9/2000 |
| JP | 2007-227695 | 9/2007 |

OTHER PUBLICATIONS

JP2007-227695 machine translation.*
Office Action issued Nov. 20, 2012 in Japanese Application No. 2009-260934 filed Nov. 16, 2009 (w/English translation).

* cited by examiner

*Primary Examiner* — Stephen Jones
(74) *Attorney, Agent, or Firm* — Oblon, Spivak, McClelland, Maier & Neustadt, L.L.P.

(57) ABSTRACT

Provided are a high frequency attenuator to attenuate high frequency energy by a minute amount and a high frequency device using the high frequency attenuator. The attenuator includes a dielectric base, a ground conductor provided on a back surface of the base, a first and second strip conductors provided on a front surface of the base, and a resistor. The first and second strip conductors constitute first and second high frequency transmission lines respectively in conjunction with the ground conductor and the base. The first strip conductor has a first end portion, and the second strip conductor has a second end portion which forms a gap with the first end portion. The resistor is provided in the gap. The first end portion is inclined with respect to the first high frequency transmission line, and the second end portion is inclined with respect to the second high frequency transmission line.

1 Claim, 9 Drawing Sheets

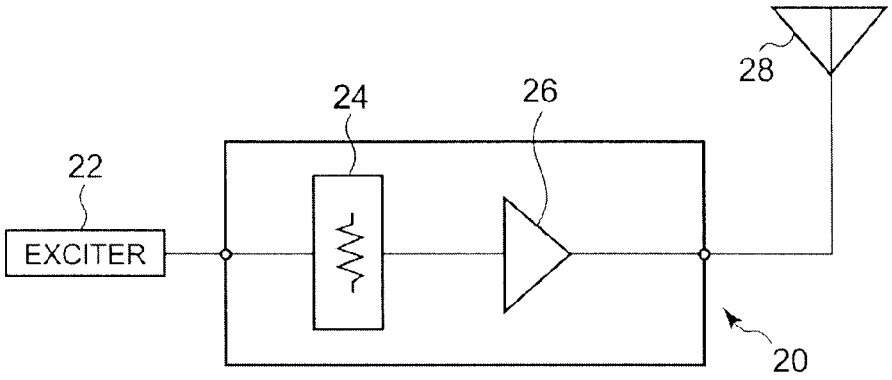
FIG. 7
FIG. 8
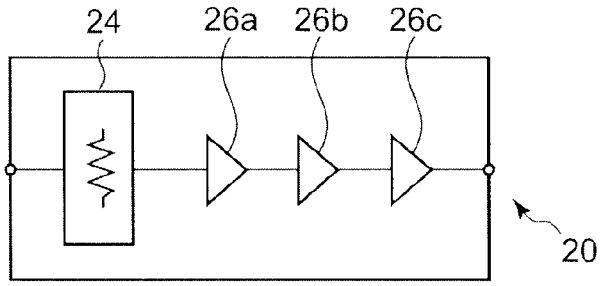
FIG. 9
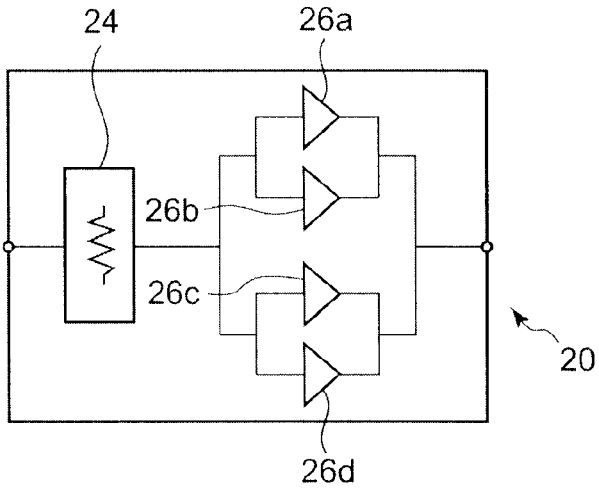

PRIOR ART

PRIOR ART

HIGH FREQUENCY ATTENUATOR AND HIGH FREQUENCY DEVICE USING THE SAME

CROSS-REFERENCE TO RELATED APPLICATION(S)

This application is based upon and claims the benefit of priority from the prior Japanese Patent Application No. 2009-260934, filed on Nov. 16, 2009, the entire contents of which are incorporated herein by reference.

FIELD

Embodiments described herein relates to a high frequency attenuator and a high frequency device using the same.

BACKGROUND

Conventional high frequency attenuators called "n-type high frequency attenuators" will be described with reference to FIGS. 12A, 12B, and 13.

FIG. 12A is a top view of a high frequency attenuator, and FIG. 12B is a perspective view of the high frequency attenuator. A high frequency attenuator 100 includes a dielectric base 51 made of a dielectric material, strip conductors 52*a*, 52*b* provided on a front surface of the dielectric base 51, a series resistor 54 and parallel resistors 55*a*, 55*b* provided on the front surface of the dielectric base 51, and a ground conductor 56 provided on a back surface of the dielectric base. The dielectric base 51, strip conductors 52*a*, 52*b*, and ground conductor 56 form a microstrip line. The series resistor 54 is formed in a gap 57 between the strip conductors 52*a*, 52*b*. The parallel resistors 55*a*, 55*b* are connected to the ground conductor 56 by using connection means such as a through-hole 58.

In an example of the n-type high frequency attenuators where the high frequency transmission line has a characteristic impedance of 50Ω, in order to attenuate the strength of the high frequency energy at a given frequency by 1 dB, the resistance value of the series resistor 54 is about 5.8Ω at the given frequency, and the resistance values of the parallel resistors 55*a*, 55*b* are about 870Ω.

A high frequency attenuator realizing the above resistances has physical dimensions as follows. It is assumed that the dielectric base 51 is made of alumina with a relative permittivity of 10 and has a thickness of 0.381 mm. Furthermore, it is assumed that conductors provided on the front and back surfaces of the dielectric base 51 are gold, and that the resistors have a sheet resistance of 50 Ω/square. As a result of calculation, the line width of the high frequency transmission line is about 0.36 mm. When the width of the series resistor 54 is about 0.36 mm which is the same as the width of the high frequency transmission line, a length 57 of the series resistor 54 is about 0.042 mm. When the widths of the parallel resistors 55*a*, 55*b* are 0.05 mm, the lengths of the parallel resistors 55*a*, 55*b* are about 0.87 mm.

FIG. 13 is a top view of another high frequency attenuator, in which the parallel resistors 55*a*, 55*b* of FIGS. 12A and 12B are omitted. When the attenuation of the high frequency attenuator is especially small, the resistance values of the parallel resistors 55*a*, 55*b* are extremely high, as high as about 870Ω as described above, and the existence of the parallel resistors 55*a*, 55*b* has a comparatively small effect. In such a case, even if the parallel resistors 55*a*, 55*b* are omitted, the characteristic impedance of the entire high frequency attenuator 101 is not much different from the characteristic impedance 50Ω of the strip conductors 52*a*, 52*b*, and the reflective characteristic represented by V. S. W. R. (voltage standing wave ratio) is little degraded. The high frequency attenuator 101 can be therefore constituted without the parallel resistors 55*a*, 55*b*.

In addition to the n-type high frequency attenuators, T-type high frequency attenuators including resistors arranged in the T shape are known. In the attenuator including resistors arranged in the T shape as well, the resistance values of two series resistors connected in series and a parallel resistor are obtained by calculation so that the characteristic impedance of the two series resistors seen from the input end and the characteristic impedance value seen from the output end are equal to 50Ω. The width and length of each resistor are calculated based on the calculated resistance values of the three resistors.

The attenuator is manufactured by patterning conductor films and resistor films formed on the base by using the photolithography method, for example, on the basis of the width of the strip conductor and the width and length of each resistor, which are determined by the above calculation. Moreover, a high frequency attenuator is used in a high frequency device together with an amplifier, a frequency converter, and the like. In such a high frequency device, the attenuator attenuates the strength of the high frequency energy applied thereto.

High frequency attenuators configured to attenuate high frequency energy by several dB or more are widely used. Manufacturing the high frequency attenuators having a characteristic impedance of 50Ω and an attenuation of not less than several dB does not have any technical difficulties.

The high frequency attenuators have been known (JP, P2000-183609A, JP, UH03-44305A, for example). Moreover, there is a known micro-wave transmission line in which circuit elements are provided on a portion of the surface of the dielectric substrate exposed by forming an opening in a strip conductor (JP, PH09-270609A). JP, PH09-270609A discloses that the circuit elements are constituted of a ground pattern connected to a ground conductor on the back surface of the dielectric substrate and a thin-film resistor connected to between the ground pattern and strip conductor.

In order to finely adjust the high frequency performances including output power and gain, attenuators are required to be configured to attenuate energy by a minute amount of less than 1 dB. For example, in the case of manufacturing an attenuator with an attenuation of 0.5 dB, a series resistor 54 and parallel resistors 55*a*, 55*b* having desired widths cannot be produced. The strip conductors or gap between the strip conductors produced using photolithography, for example, vary in dimensions.

Consideration is made on the case of implementing a n-type high frequency attenuator with an attenuation of 0.5 dB. The resistance values of the series resistor 54 and the parallel resistors 55*a*, 55*b* are obtained by circuitry calculation as about 2.9Ω and about 1738Ω, respectively. Next, physical dimensions of the attenuator implementing the aforementioned resistance values are calculated. When the width of the series resistor 54 is about 0.36 mm, a pattern gap 57 between the strip conductors 52*a*, 52*b*, or the length of the series resistor 54, is about 0.021 mm. When the widths of the parallel resistors 55*a*, 55*b* are 0.05 mm, both of the lengths of the parallel resistors 55*a*, 55*b* are about 1.74 mm. The length of the pattern gap 57, namely, the length of the series resistor 54 is nearly marginal for stable patterning by the photolithography method, for example, in a manufacturing process and falls in a range where process defects are more likely to occur. Moreover, the accuracy of the patterns or gap between the patterns causes degradation of the accuracy of the resistance values, thus resulting in degraded accuracy of the attenuation of the high frequency attenuator.

Furthermore, the width of the high frequency transmission line of a high frequency attenuator using a thin dielectric base is smaller than the width of the high frequency transmission line of a high frequency attenuator using a thick dielectric base when the attenuators with the thin and thick dielectric bases have the same characteristic impedance. In other words, the thinner the base is, the narrower the width of the high frequency transmission line is for the same characteristic impedance. Accordingly, implementation of high frequency attenuators is almost impossible. In manufacturing high frequency attenuators configured to attenuate the high frequency energy by a minute amount, stable production of patterns with desired widths is marginal, thus increasing the possibility of process defects. Moreover, the low accuracy of the resistance values leads to low accuracy of the attenuation. Accordingly, the high frequency attenuators having desired attenuations are difficult to manufacture, or practically cannot be manufactured.

BRIEF DESCRIPTION OF THE DRAWINGS

FIG. 7 is a block diagram of a high frequency device of an embodiment;

FIG. 8 is a block diagram of a high frequency device of the embodiment;

FIG. 9 is a block diagram of a high frequency device of the embodiment;

DETAILED DESCRIPTION

Figure 1:
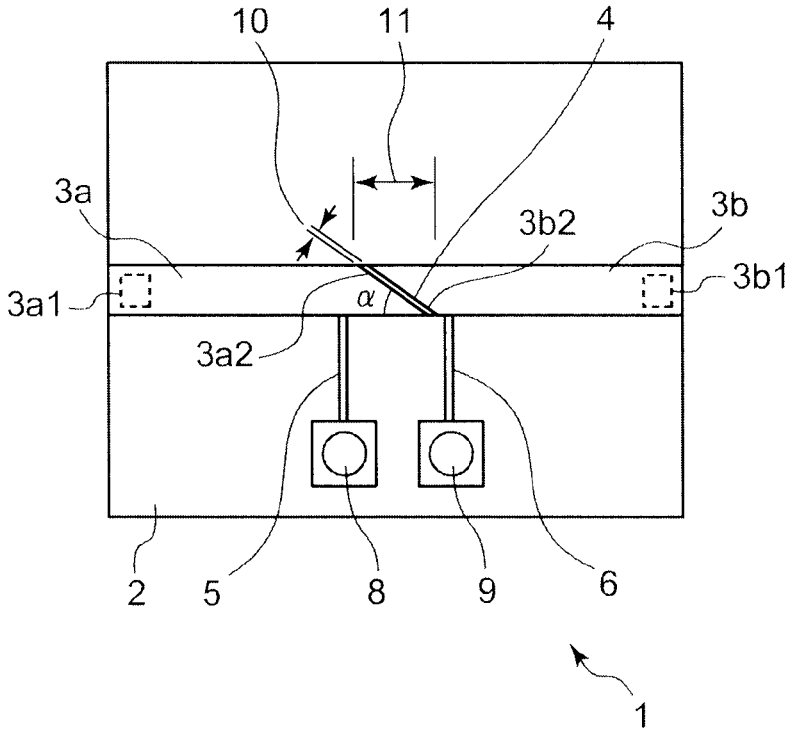
FIG. 1 is a top view of a high frequency attenuator according to a first embodiment.

According to an embodiment, a high frequency attenuator includes a dielectric base, a ground conductor, a first strip conductor, a second strip conductor, and a resistor. The ground conductor is provided on a back surface of the dielectric base. The first strip conductor is provided on a front surface of the dielectric base, constitutes a first high frequency transmission line in conjunction with the ground conductor and the dielectric base, and has a first end portion. The second strip conductor is provided on the front surface of the dielectric base, constitutes a second high frequency transmission line in conjunction with the ground conductor and the dielectric base, and has a second end portion. The second end portion faces the first end portion and forms a gap with the first end portion. The resistor is provided in the gap on the front surface of the dielectric base and is electrically connected to the first and second strip conductors. In the high frequency attenuator, the first end portion is inclined with respect to the first high frequency transmission line, and the second end portion is inclined with respect to the second high frequency transmission line.

According to another embodiment, a high frequency device includes a high frequency amplifier to amplify a high frequency signal and a high frequency attenuator connected to the high frequency amplifier. The high frequency attenuator includes a dielectric base, a ground conductor, a first strip conductor, a second strip conductor, and a resistor. The ground conductor is provided on a back surface of the dielectric base. The first strip conductor is provided on a front surface of the dielectric base, constitutes a first high frequency transmission line in conjunction with the ground conductor and the dielectric base, and has a first end portion. The second strip conductor is provided on the front surface of the dielectric base, constitutes a second high frequency transmission line in conjunction with the ground conductor and the dielectric base, and has a second end portion. The second end portion faces the first end portion and forms a gap with the first end portion. The resistor is provided in the gap on the front surface of the dielectric base and is electrically connected to the first and second strip conductors. In the high frequency device, the first end portion is inclined with respect to the first high frequency transmission line, and the second end portion is inclined with respect to the second high frequency transmission line.

According to still another embodiment, a high frequency device includes a frequency converter converting frequency of a high frequency signal and a high frequency attenuator connected to the frequency converter. The high frequency attenuator includes a dielectric base, a ground conductor, a first strip conductor, a second strip conductor, and a resistor. The ground conductor is provided on a back surface of the dielectric base. The first strip conductor is provided on a front surface of the dielectric base, constitutes a first high frequency transmission line in conjunction with the ground conductor and the dielectric base, and has a first end portion. The second strip conductor is provided on the front surface of the dielectric base, constitutes a second high frequency transmission line in conjunction with the ground conductor and the dielectric base, and has a second end portion. The second end portion faces the first end portion and forms a gap with the first end portion. The resistor is provided in the gap on the front surface of the dielectric base and is electrically connected to the first and second strip conductors. In the high frequency device, the first end portion is inclined with respect to the first high frequency transmission line, and the second end portion is inclined with respect to the second high frequency transmission line.

According to the embodiments, it is possible to manufacture a high frequency attenuator having a margin to the manufacturing restriction in a process of manufacturing the resistors. Moreover, according to the embodiments, it is possible to manufacture a high frequency attenuator without degrading the accuracy of the attenuation. Furthermore, according to the embodiments, high frequency energy can be attenuated by a minute amount. For example, it is possible to provide a high frequency attenuator having an attenuation of less than 1 dB, for example, an attenuation of about 0.5 dB and provide a high frequency device using the high frequency attenuation.

Hereinafter, high frequency attenuators according to the embodiments and high frequency devices including the high frequency attenuators will be described with reference to FIGS. 1 to 11. In the drawings, same portions are given same reference numerals, and the redundant description is omitted.

First Embodiment

A high frequency attenuator according to a first embodiment will be described.

Figure 2:
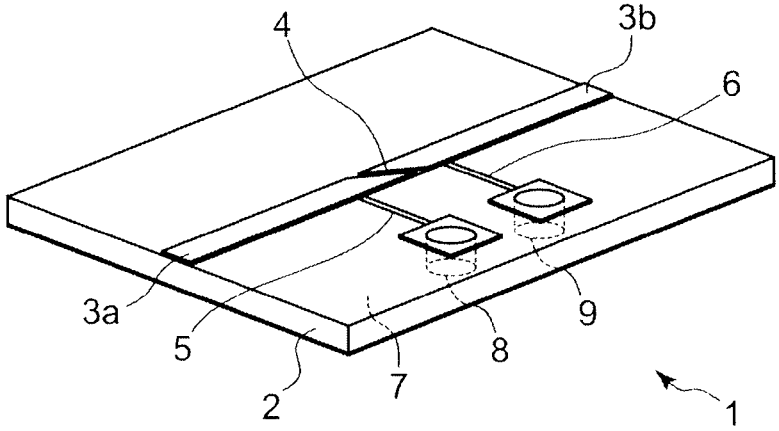
FIG. 2 is a perspective view of the high frequency attenuator according to the first embodiment.

FIG. 1 is a top view of the high frequency attenuator. FIG. 2 is a perspective view of the high frequency attenuator. In the drawings, same reference numerals indicate same elements. The high frequency attenuator 1 is a π-type high frequency attenuator. A high frequency signal is inputted through an input pad 3*a*1, and the attenuated high frequency signal is outputted through an output pad 3*b*1.

The high frequency attenuator 1 includes a dielectric base 2 made of a dielectric material, strip conductors 3*a*, 3*b* provided on a front surface of the dielectric base 2, a series resistor 4 and parallel resistors 5, 6 provided on the front surface of the dielectric base 2, and a ground conductor 7 provided in close contact with the entire back surface of the dielectric base 2. The parallel resistors 5, 6 are connected to the ground conductor 7 by through-holes 8, 9. Each of the through-holes 8, 9 is filled with a conductor or has a conductor applied to the inner wall. The series resistor 4 is arranged obliquely to the strip conductors 3*a*, 3*b*.

The dielectric material 2, strip conductors 3*a*, 3*b*, and ground conductor 7 form a microstrip line as a high frequency transmission line. The microstrip line is configured so that characteristic impedances of the microstrip line seen from input pad 3*a*1 and output pad 3*b*1 are both 50Ω.

The dielectric base 2 is a ceramic substrate made of alumina or the like, for example. Each of the strip conductors 3*a*, 3*b* is a conductor film having a predetermined shape. Each of the series resistor 4 and parallel resistors 5, 6 is a resistor film formed in a predetermined shape on the dielectric base 2. When the dielectric base 2 is a ceramic substrate such as alumina, the strip conductors 3*a*, 3*b*, series resistor 4, and parallel resistors 5, 6 are formed as follows. Nichrome or the like is deposited on the dielectric base 2 to form a resistor thin film, which is then etched into a predetermined shape. Gold or the like is then deposited on the resistor film and dielectric base 2. Thereafter, the conductor thin film is partially removed by etching into a predetermined shape, thus forming the strip conductors 3*a*, 3*b* and through-holes 8, 9. The strip conductors 3*a*, 3*b*, respectively, include end portions 3*a*2, 3*b*2 obliquely inclined with respect to the transmission direction of a high frequency signal. The end portions 3*a*2, 3*b*2 face each other across a gap 10. The conductor thin film is partially removed to expose the resistor film, thus forming the parallel resistors 5, 6. Moreover, the conductor thin film is partially removed at a portion corresponding to the gap 10 so that the strip conductors 3*a*, 3*b* face each other across the gap 10, and the resistor film is therefore exposed in the gap 10 to form the series resistor 4. The strip conductors 3*a*, 3*b* are connected to the series resistor 4.

The high frequency signal is transmitted through the strip conductors 3*a*, 3*b* from the input pad portion 3*a*1 to the output pad portion 3*b*1. The series resistor 4 obliquely arranged between the strip conductors 3*a*, 3*b* functions as resistors distributed along the transmission direction of the high frequency signal when the series resistor 4 is seen by the high frequency signal.

High frequency current flowing through the conductors propagates from left to right through the strip conductors 3*a*, 3*b* as entering the strip conductors 3*a*, 3*b* to a skin depth. The high frequency current goes out through the oblique end portion 3*a*2 placed in the right side of the strip conductor 3*a* and enters the series resistor 4. The high frequency current then propagates in a medium of the resistor film constituting the series resistor 4, and the series resistor 4 therefore acts on the high frequency current as a resistance component. The high frequency current then goes into the strip conductor 3*b* from the series resistor 4 through the oblique end portion 3*b*2 placed in the left side of the strip conductor 3*b* and propagates to right in the stripe conductor 3*b*.

Reference numeral 11 indicates the length of a portion of the entire region of the strip conductors 3*a*, 3*b* along the transmission direction of the high frequency signal in which the series resistor 4 contributes to the high frequency signal as resistance. An angle α between the series resistor 4 and the edges of the longitudinal edges of the strip conductors 3*a*, 3*b* is determined so that the length 11 may be shorter than the wavelength of the high frequency signal. In other words, the resistor film is not considered as a lumped constant circuit element in the high frequency attenuator 1. Accordingly, there is a need for a technique such as an electromagnetic field analysis to design a pattern of the resistors which provides a necessary attenuation.

Figure 12A:
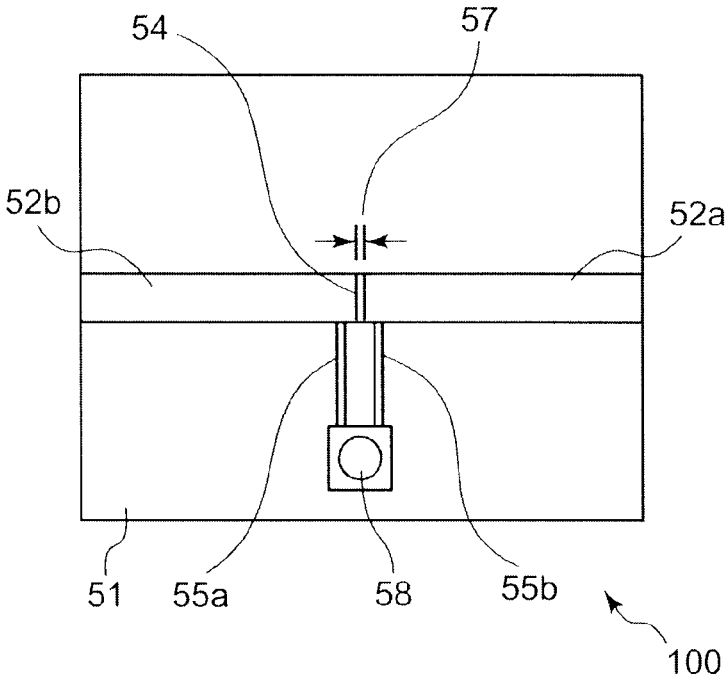
FIG. 12A PRIOR ART
FIG. 12A is a top view of a conventional high frequency attenuator.
Figure 12B:
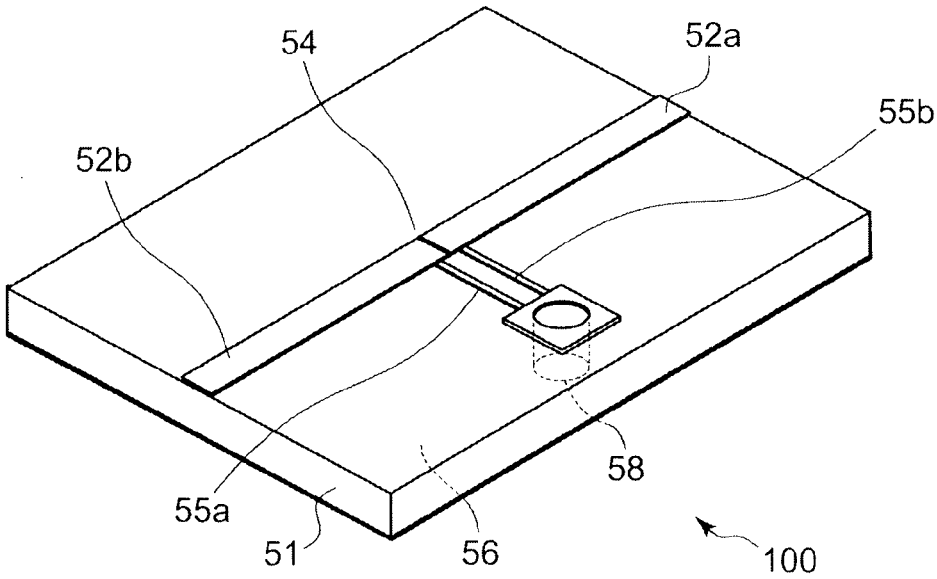
FIG. 12B is a perspective view of the conventional high frequency attenuator.

The angle between the series resistor 4 and the longitudinal edges of the strip conductors 3*a*, 3*b*, the pattern thickness, the pattern width, and the like are calculated by electromagnetic field simulation. The simulation software used in this embodiment is em of Sonnet Software Inc. The electromagnetic field analysis is performed under the condition that the high frequency attenuator 1 attenuates the inputted high frequency energy by 0.5 dB. The dielectric base is made of alumina with a relative permittivity of 10 and has a thickness of 0.381 mm. The conductor films on the front and back surfaces of the dielectric base are gold, and the resistor film has a sheet resistance value of 50 Ω/square. As a result of the analysis, the width 10 of the series resistor 4 is about 0.04 mm, and the angle α between the series resistor 4 and the longitudinal edges of the strip conductors 3*a*, 3*b* is about 30 degrees. The width 10 of the series resistor 4 is substantially equal to the length of a gap 57 constituting the series resistor of a conventional attenuator with 1 dB attenuation, which is shown in FIG. 12A. The length of the parallel resistors is about 1.74 mm when the width of the parallel resistors is 0.05 mm.

In the case of using the photolithography, the line-and-space rule representing the manufacturing limits is governed by the wavelength of irradiation light for etching. Accordingly, there is a manufacturing restriction at manufacturing the high frequency attenuator 1. But the aforementioned values have margins to the manufacturing restriction.

Figure 3A:
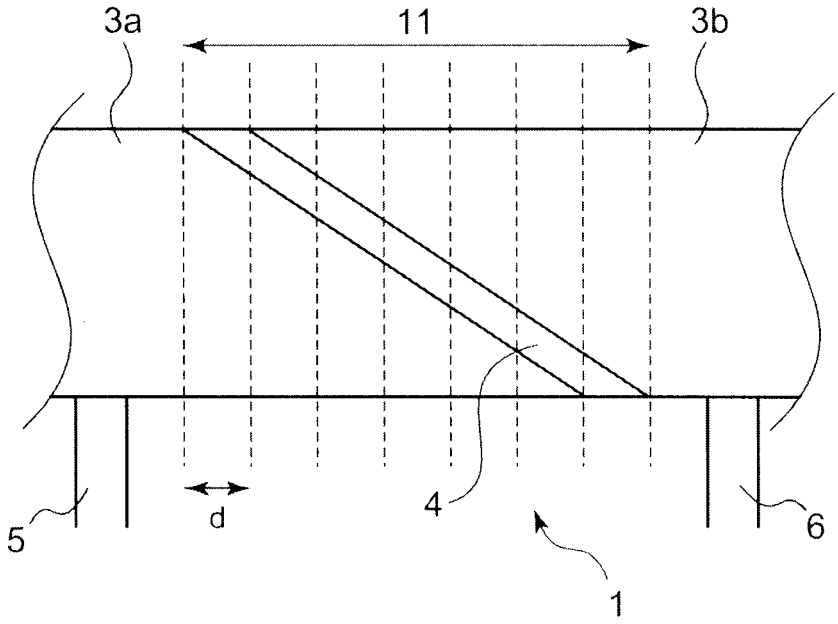
FIG. 3A is a view for explaining a principle of the high frequency attenuator according to the embodiments.
Figure 3B:
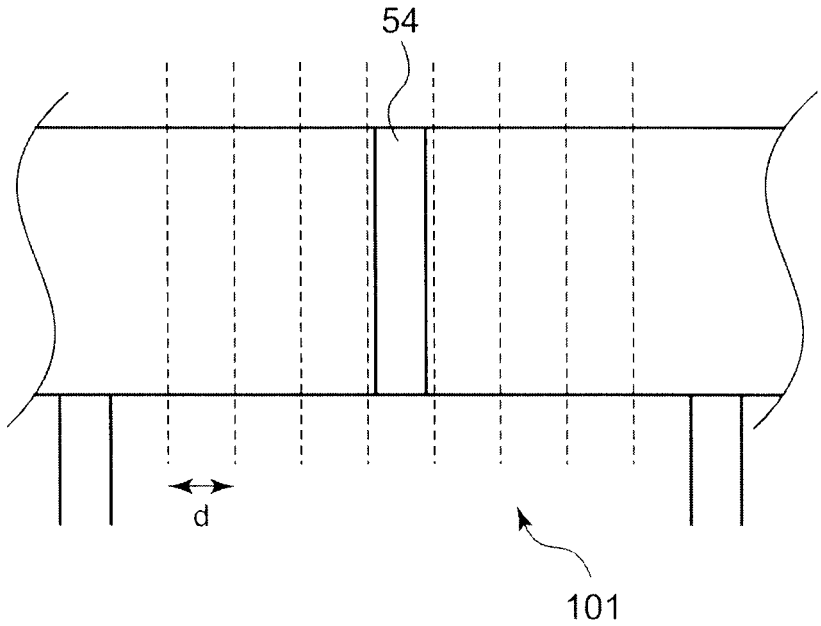
FIG. 3B is a view for explaining a principle of a high frequency attenuator according to a comparative example.

The principle of the embodiment will be described with reference to FIGS. 3A and 3B. FIG. 3A is an enlarged top view of a main portion of the high frequency attenuator 1, and FIG. 3B is an enlarged top view of a main portion of a high frequency attenuator 101 of the comparative example. In the drawings, the reference numerals already described indicate the same elements. In FIG. 3B, when a high frequency signal propagates, the high frequency signal is subjected to resistance with a resistance value uniform in the transmission direction of the high frequency signal only in a minute region including a series resistor 54 and having a width d in the transmission direction. The resistor is distributed only at one place in the transmission direction of the high frequency signal.

On the other hand, in FIG. 3A, the series resistor 4 is obliquely provided, and the high frequency signal is subjected to resistance in each minute region little by little. Given that the series resistor 4 is divided into the minute regions, the high frequency signal is subjected to the resistance of a piece of the resistor film at each of the minute regions along the transmission direction. The series resistor 4 can be considered to be equivalent to resistors distributed at a plurality of places in the transmission direction and therefore has a small resistance value for the high frequency signal. By continuously repeating very small attenuation at the individual minute regions, the high frequency attenuator 1 obtains a desired amount of attenuation.

The wavelength of the electromagnetic wave propagating in a high frequency transmission line is shorter than the wavelength of the electromagnetic wave propagating in vacuum because of the influence of the dielectric medium. When the frequencies of the electromagnetic waves are 3 GHz and 10 GHz, for example, the wavelengths are about 100 mm and 30 mm in vacuum, respectively, while the wavelengths in the dielectric base 2 with a relative permittivity of 10, for example, are about 40 mm and 12 mm, respectively. In the simulation, the inclination of the series resistor 4 is determined so that the length 11 of the series resistor 4 along the transmission line may be shorter than the wavelength of the electromagnetic wave propagating in the dielectric base 2.

The smaller the angle of inclination of the series resistor 4 is, the longer the length 11 of the series resistor 4 along the transmission line is. If the length 11 of the series resistor 4 along the transmission line is longer than the wavelength of the electromagnetic wave propagating in the dielectric base 2, a sufficient amount of attenuation cannot be obtained. When the length 11 of the series resistor 4 along the transmission line is excessively longer than the wavelength of the electromagnetic wave, the transmission line including the series resistor 4 is equivalent to a line almost not having a resistance component for the propagating electromagnetic wave. On the other hand, when the length 11 of the series resistor 4 along the transmission line is shorter than the wavelength in the dielectric base 2 and is within a minute distance, the propagating electromagnetic wave is considered to be subjected to strong action by the resistance component.

As described above, in the high frequency attenuator 1, the series resistor 4 is arranged obliquely to the conductor of the high frequency transmission line. When the length 11 of the series resistor 4, which is arranged obliquely to the conductor of the high frequency transmission line, along the high frequency transmission line is shorter than the wavelength of the electromagnetic wave, it is possible to reduce the high frequency resistance value without narrowing the gap 10 between the strip conductors 3*a*, 3*b*. It is therefore possible to manufacture an attenuator with an attenuation of not more than 1 dB, for example, an attenuation of 0.5 dB.

By etching the conductor film using photolithography or the like without conflicting with the limit in the manufacturing process, it is possible to manufacture the gap 10 between the strip conductors 3*a*, 3*b* without causing process defects and thus manufacture the high frequency attenuator 1. Furthermore, it is possible to implement an attenuator with an attenuation of less than 1 dB, such as 0.5 dB, without consideration about dimensional variations and degradation of the accuracy of the pattern widths of the resistors and strip conductors and the gap between the strip conductors 3*a*, 3*b*, which depend on the etching accuracy.

As described above, in the high frequency attenuator 1 according to the embodiment, the series resistor 4 is arranged obliquely to the conductor of the high frequency transmission line. When the length of the range where the series resistor 4 obliquely extends is shorter than the wavelength of the propagating electromagnetic wave, the high frequency resistance value can be reduced without narrowing the width of the portion corresponding to the series resistor 4. According to the embodiment, therefore, the high frequency attenuator 1 can be manufactured with a sufficient margin to the manufacturing limit of the gap between the microstrip lines, which define the series resistor, in the manufacturing process. Moreover, according to the embodiment, the high frequency attenuator 1 can be manufactured without degradation of the accuracy of attenuation, which is characteristic of only the high frequency attenuator of the embodiment configured to attenuate high frequency energy by a minute amount.

Second Embodiment

A high frequency attenuator according to a second embodiment will be described. The high frequency attenuator of the second embodiment does not include the parallel resistors 5, 6 shown in FIG. 1.

Figure 4:
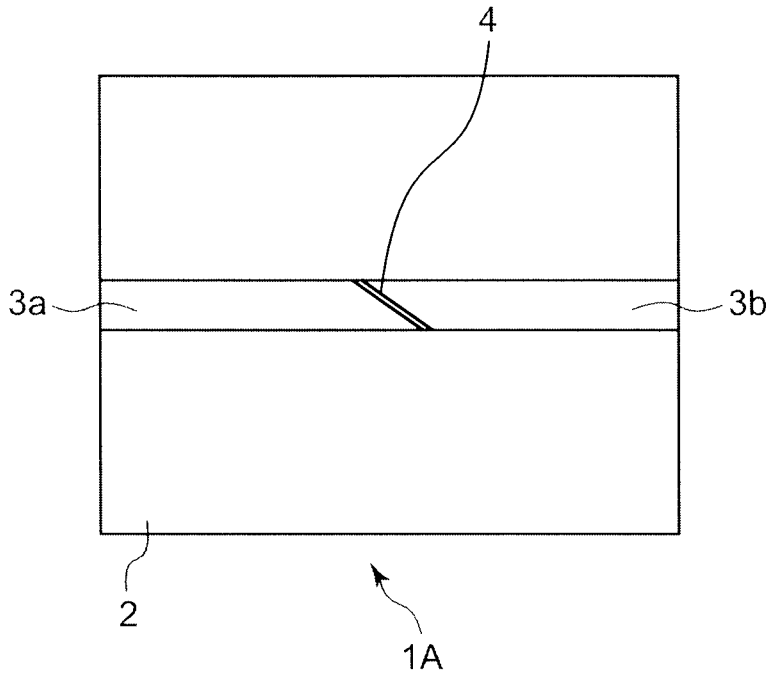
FIG. 4 is a top view of a high frequency attenuator according to a second embodiment.

FIG. 4 is a top view of the high frequency attenuator according to the second embodiment. The already described reference numerals indicate the same portions. A high frequency attenuator 1A is a n-type microwave attenuator. At manufacturing an attenuator configured to attenuate high frequency energy by a particularly small amount, resistance values of the two resistors to be connected in parallel to the strip conductors 3*a*, 3*b* as the conductors of the high frequency transmission line are extremely large. This means that the existence of the two resistors has comparatively less effect on the impedance in the frequency range of the propagating electromagnetic wave. In such a case, even if the parallel resistors are omitted, the characteristic impedance of the high frequency attenuator 1A is not much different from the characteristic impedance of the high frequency transmission line, which is 50Ω, and the reflection characteristics represented by V. S. W. R. are little degraded. Accordingly, the characteristic impedance does not change in the middle of the transmission line, and there is no reflected wave, thus making it possible to maintain the matching of the transmission line.

The high frequency attenuator according to the second embodiment does not include the parallel resistors 5, 6 of the first embodiment of FIG. 1. Accordingly, the through-holes 8, 9 for the parallel resistors 5, 6 are also unnecessary, and the high frequency attenuator of the second embodiment can be manufactured more easily than that of the first embodiment. Also in the second embodiment, it is possible to easily form the gap of the strip line defining the series resistor 4 of the high frequency attenuator 1A having an attenuation of less than 1 dB such as an attenuation of 0.5 dB.

Next, high frequency attenuators according to various embodiments will be described. Each of the high frequency attenuators described below includes a dielectric base, a series resistor, parallel resistors, strip conductors, and a ground conductor. The series resistor, parallel resistors, and strip conductors are formed on the front surface of the dielectric base. The ground conductor is formed on the back surface of the dielectric base.

Third Embodiment

Figure 5A:
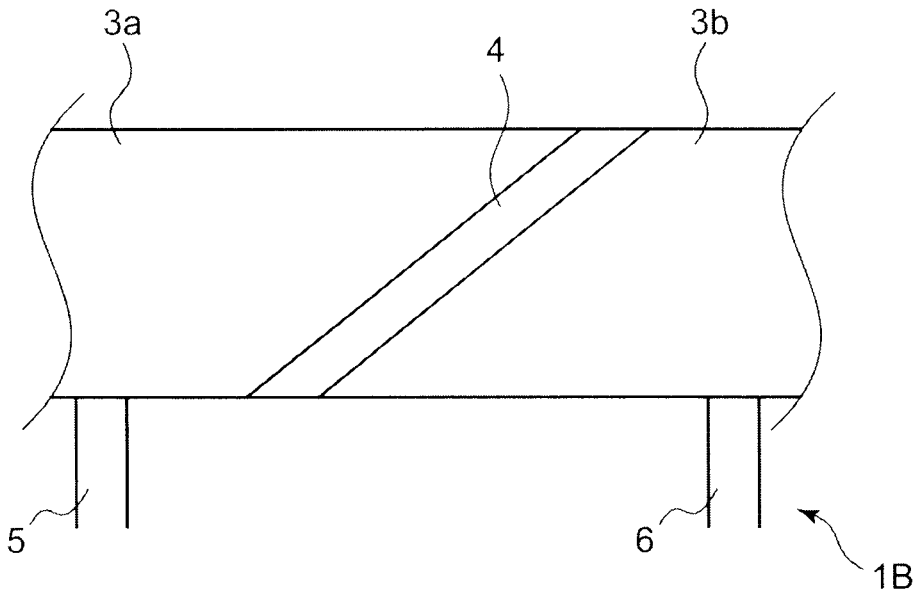
FIG. 5A is an enlarged top view of a main portion of a high frequency attenuator according to a third embodiment.

FIG. 5A is an enlarged top view of a main portion of a high frequency attenuator according to a third embodiment. In the drawing, the reference numerals already described indicate the same elements. A high frequency attenuator 1B is the high frequency attenuator of the first embodiment with the series resistor 4 inclined oppositely to the high frequency attenuator of the first embodiment.

Fourth Embodiment

Figure 5B:
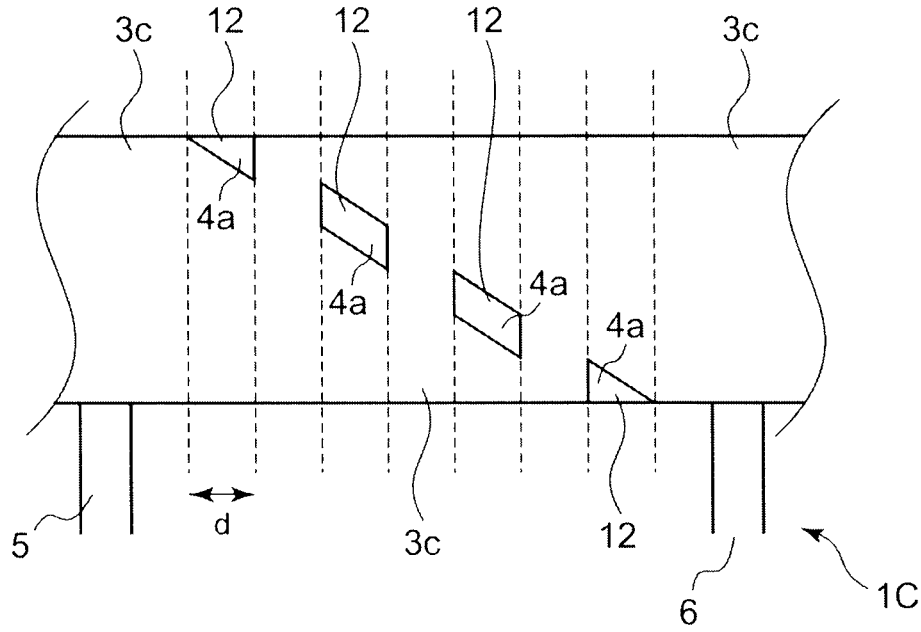
FIG. 5B is an enlarged top view of a main portion of a high frequency attenuator according to a fourth embodiment.

FIG. 5B is an enlarged top view of a main portion of the high frequency attenuator according to a fourth embodiment. In the drawing, the reference numerals already described indicate the same elements. In the high frequency attenuator 1C, the strip conductor 3C includes a plurality of openings 12 arranged in a direction oblique to the transmission direction of the high frequency signal. The plurality of openings 12 are formed when the strip conductor 3C is formed. The resistor film, formed on the dielectric base 2 is exposed in the openings 12 and is connected to the strip conductor through the edges of the resistor film, functioning as individual resistors 4*a*. The plurality of resistors 4*a* constitute a series resistor as a whole. The shape of the openings 12 is not limited to the shape shown in the drawing but may be another shape including a square.

The high frequency attenuator 1C can implement an attenuation of less than 1 dB such as attenuation of 0.5 dB attenuation, too. The values of inclination, size, and the like of the plurality of openings 12 are determined by simulation with the values and parameters necessary for the simulation properly changed and adjusted.

Fifth Embodiment

Figure 6:
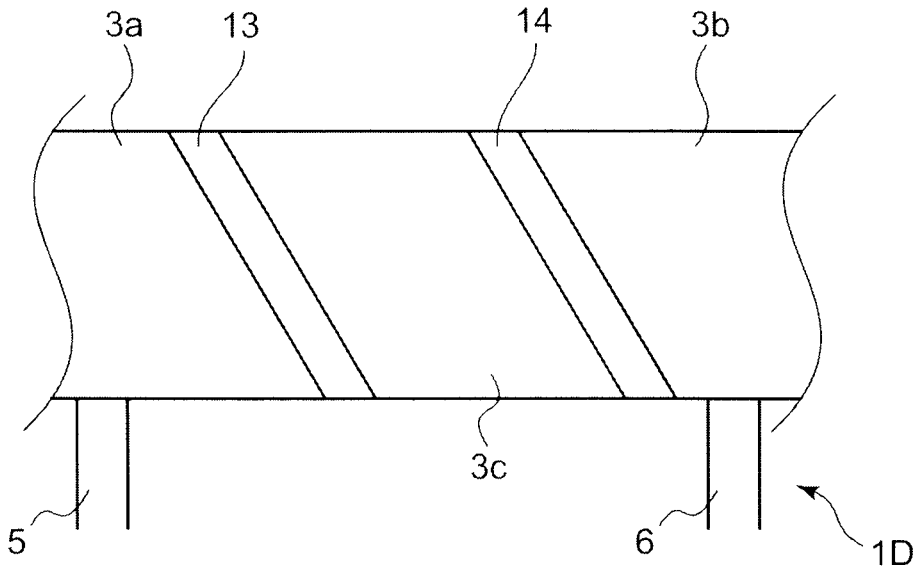
FIG. 6 is an enlarged top view of a main portion of a high frequency attenuator according to a fifth embodiment.

FIG. 6 is an enlarged top view of a main portion of a high frequency attenuator according to a fifth embodiment. The high frequency attenuator 1D includes two series resistors 13, 14 between strip conductors 3*a*, 3*c* and between a strip conductor 3*b* and the strip conductor 3*c*. The series resistors 13, 14 are formed in parallel. The width of the gap between the strip conductors 3*a*, 3*c* in which the resistor film is exposed may be either equal to or different from the width of the gap between the strip conductors 3*c*, 3*b* in which the resistor film is exposed.

The series resistors may be provided not only two places but also three places or more.

The high frequency attenuators of the embodiments include a ceramic substrate made represented by alumina and a thin film formed on the ceramic substrate. The high frequency attenuator of the invention may include a copper foil on a resin substrate represented by a glass epoxy resin substrate and a fluorine resin substrate. When the strip conductors are formed with the copper foil, generally, the accuracy limits of the pattern width and gap width are lowered.

The high frequency attenuator of the invention may include a multi-layer substrate.

Next, a high frequency device using a high frequency attenuation of each embodiment will be described.

Sixth Embodiment

FIG. 7 is a block diagram of the high frequency device using the high frequency attenuator of any one of the embodiments described above. The high frequency device is a transmitter. The transmitter 20 includes an exciter 22, a high frequency attenuator 24, and a high frequency amplifier 26. A high frequency signal outputted from the exciter 22 is inputted to the high frequency amplifier 26, which amplifies the high frequency signal. An antenna 28 emits the power-amplified high frequency signal. In the sixth embodiment, the high frequency attenuator 24 is connected to the input side of the high frequency amplifier 26. The high frequency attenuator 24 may be any one of the aforementioned various embodiments.

In FIG. 7, the transmitter 20 includes the high frequency amplifier 26. However, the transmitter 20 may include a plurality of high frequency amplifiers 26*a*, 26*b*, 26*c* connected in series as shown in FIG. 8. Alternatively, the transmitter 20 may include the high frequency amplifiers 26*a*, 26*b*, 26*c* connected in parallel as shown in FIG. 9.

Seventh Embodiment

Figure 10:
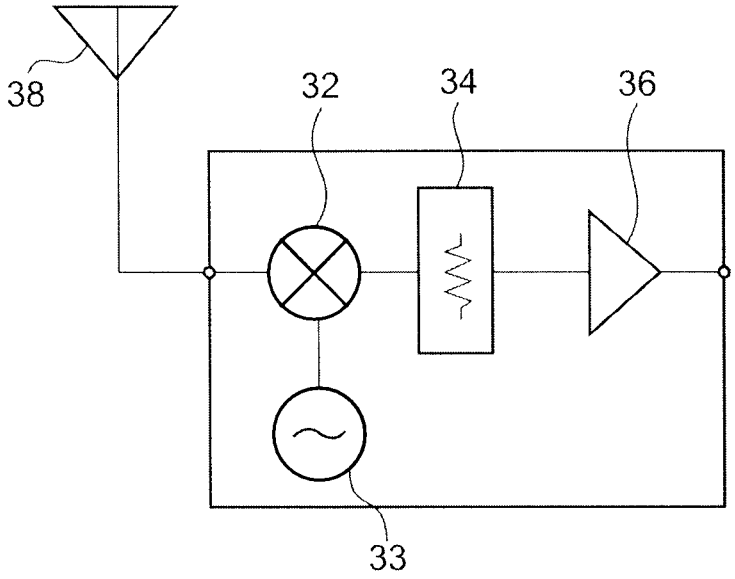
FIG. 10 is a block diagram of a high frequency device of another embodiment.

FIG. 10 is a block diagram of another high frequency device using any one of the high frequency attenuators of the aforementioned embodiments. The high frequency device is a receiver. The receiver 30 includes a frequency converter 32, a local oscillator 33, a high frequency attenuator 34, and an intermediate frequency amplifier 36. The intermediate frequency amplifier 36 is a high frequency amplifier amplifying a high frequency signal with an intermediate frequency. The high frequency signal received by the antenna 38 and a local signal generated by the local oscillator 33 are inputted to the frequency generator 32 and then is mixed by the frequency converter 32 to generate the high frequency signal with an intermediate frequency. The high frequency signal with an intermediate frequency is inputted into the intermediate frequency amplifier 36 through the amplifier attenuator 34 and is amplified by the intermediate frequency amplifier 36. The signal amplified by the intermediate frequency amplifier is processed by a not-shown circuit at a following stage. In the seventh embodiment, the high frequency attenuator 34 is connected to the input side of the intermediate frequency amplifier 36. The high frequency attenuator 34 may be any one of the aforementioned various high frequency attenuators.

Eighth Embodiment

Figure 11:
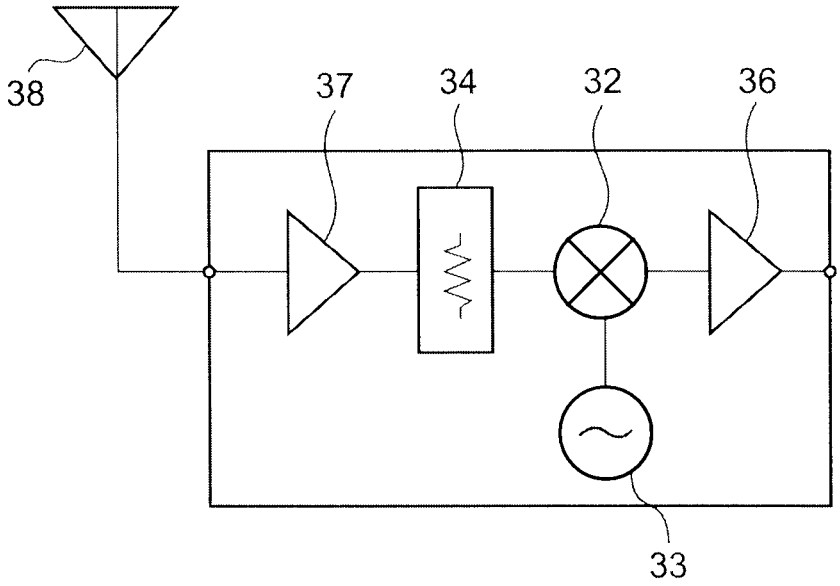
FIG. 11 is a block diagram of a high frequency device of the embodiment.
Figure 13:
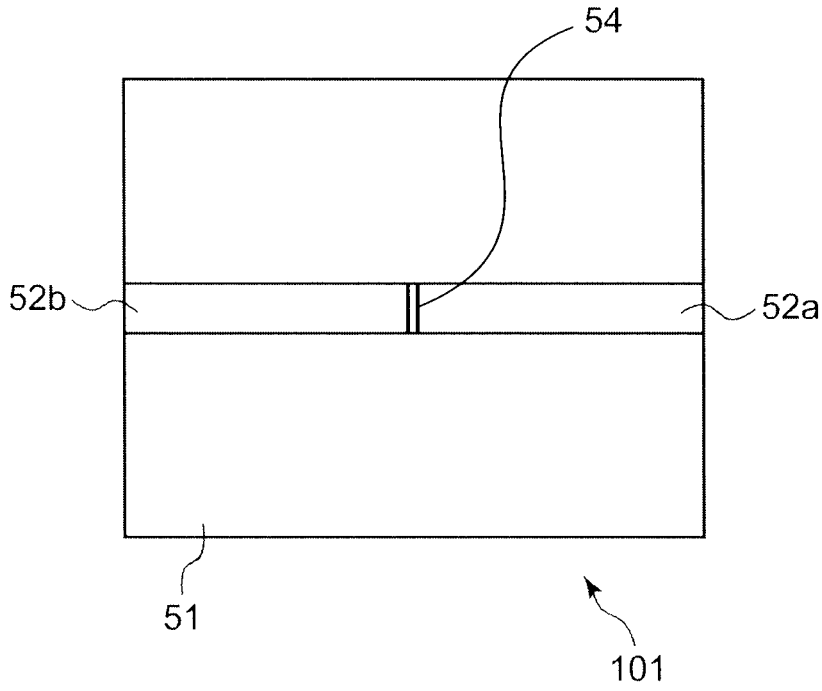
FIG. 13 is a top view of another conventional high frequency attenuator.

FIG. 11 shows a block diagram of a high frequency device having another configuration. The high frequency device is a receiver. The receiver 30, which is different from the receiver shown in FIG. 13, includes a high frequency amplifier 37 and a high frequency attenuator 34 connected to the high frequency amplifier 37 between the antenna 38 and frequency converter 32. A high frequency signal received by the antenna 38 is amplified by the high frequency amplifier 37 and then inputted to the frequency converter 32 through the high frequency attenuator 34. The frequency converter 32 receives also the local signal from the local oscillator 33 and mixes the high frequency signal and local signal to generate the high frequency signal having an intermediate frequency. The high frequency signal with the intermediate frequency is amplified by the intermediate frequency amplifier 36. The signal amplified by the intermediate frequency amplifier 36 is processed by a not-shown circuit at the following stage.

While certain embodiments have been described, these embodiments have been presented by way of example only, and are not intended to limit the scope of the inventions. Indeed, the novel systems described herein may be embodied in a variety of other forms; furthermore, various omissions, substitutions and changes in the form of the systems described herein may be made without departing from the spirit of the inventions. The accompanying claims and their equivalents are intended to cover such forms or modifications as would fall within the scope and spirit of the inventions.

What is claimed is:

1. A high frequency attenuator, comprising:

a dielectric base;

a ground conductor provided on a back surface of the dielectric base;

a strip conductor provided on a front surface of the dielectric base, the strip conductor constituting a high frequency transmission line to transmit a signal in conjunction with the ground conductor and the dielectric base, the strip conductor including a slit extending in a direction oblique to a direction in which the signal is transmitted; and a resistor provided in the slit on the front surface of the dielectric base and connected to the strip conductor at both ends of the resistor in the direction in which the signal is transmitted.

* * * * *